United States Patent [19]

Wening

[11] 4,012,104

[45] * Mar. 15, 1977

[54] BATTERY TERMINAL CONNECTOR AND HOUSING ASSEMBLY

[76] Inventor: Richard R. Wening, 2113 N. Eastside St., Santa Ana, Calif. 92701

[ * ] Notice: The portion of the term of this patent subsequent to Feb. 27, 1990, has been disclaimed.

[22] Filed: Feb. 10, 1975

[21] Appl. No.: 548,588

Related U.S. Application Data

[63] Continuation-in-part of Ser. No. 405,587, Oct. 11, 1973, Pat. No. 3,867,007, which is a continuation-in-part of Ser. No. 293,334, Sept. 29, 1972, Pat. No. 3,790,920, which is a continuation-in-part of Ser. No. 154,737, June 21, 1971, Pat. No. 3,718,891.

[52] U.S. Cl. ..... 339/116 C; 339/230 R

[51] Int. Cl.[2] ..... H01R 13/52; H01R 11/26

[58] Field of Search ..... 339/116, 230

[56] References Cited

UNITED STATES PATENTS

| | | | |
|---|---|---|---|
| 2,057,602 | 10/1936 | Wilson | 339/230 R |
| 3,152,854 | 10/1964 | Osborn | 339/116 R |
| 3,718,891 | 2/1973 | Wening | 339/116 R |
| 3,790,920 | 2/1974 | Wening | 339/116 C |
| 3,867,007 | 2/1975 | Wening | 339/116 C |

*Primary Examiner*—Roy Lake
*Assistant Examiner*—Neil Abrams
*Attorney, Agent, or Firm*—B. P. Fishburne, Jr.

[57] ABSTRACT

A storage battery terminal post receives a split connector cap formed of compatible metal. A rear extension of the cap is secured by a clamping set screw to an exposed end of a battery cable. A screw-threaded pressure sleeve is received by internal threads of a housing and has its forward end bearing on a full circle flange portion of the connector cap. The force exerted by the pressure sleeve on such flange produces closing of the split connector cap around the battery terminal post by a camming action of curved connector cap sections with a coacting curved wall of the housing.

4 Claims, 3 Drawing Figures

BATTERY TERMINAL CONNECTOR AND HOUSING ASSEMBLY

CROSS-REFERENCE TO RELATED APPLICATIONS

This application is continuation-in-part of my prior copending application Ser. No. 405,587, filed Oct. 11, 1973, for BATTERY TERMINAL CONNECTOR AND HOUSING ASSEMBLY, now U.S. Pat. No. 3,867,007, which was a continuation-in-part of application Ser. No. 293,334, filed Sept. 29, 1972, now U.S. Pat. No. 3,790,920, which was a continuation-in-part of application Ser. No. 154,737, filed June 21, 1971, now U.S. Pat. No. 3,718,891.

BACKGROUND OF THE INVENTION

The present invention is the result of a continuous development of a battery terminal connector and housing assembly for the purpose of rendering the same increasingly more efficient and foolproof. This development has resulted in the issuance of prior U.S. Pat. Nos. 3,718,891 and 3,790,920, in addition to the mentioned U.S. Pat. No. 3,867,007 of Feb. 18, 1975.

Specifically, the objective of the present invention is to improve on the above-noted prior art by providing an improved coaction in the assembly between the pressure or clamping sleeve having threaded engagement with the housing and the connector cap which embraces the battery terminal post. More particularly, in the present invention, the split connector cap is provided rearwardly of its split or divided head with an integral wall or flange whose rear face extends completely around the cap circumferentially without interruption. The rear face of this flange or wall is flat and of sufficient width to be engaged by the full forward annular face of the pressure sleeve when the device is assembled and tightened. The arrangement results in an even distribution of pressure around the full circumference of the connector cap flange which in turn produces several important advantages. The increased area of contact between the pressure sleeve and cap flange with correspondingly greater friction practically eliminates all tendency for the pressure sleeve to loosen, with the result that previously-employed serrated faces are no longer required between the connector cap and pressure sleeve nor are any lock washers, lock nuts or equivalent devices necessary. The more evenly distributed pressure exerted on the rear of the split connector cap renders the same even more secure in its binding contact with the battery terminal post. Additionally, stresses in the connector cap customarily formed of antimonial lead are less concentrated thus reducing the possibility of overstressing or fracturing the neck of the connector cap.

Other features and advantages of the invention will become apparent during the course of the following description.

BRIEF DESCRIPTION OF DRAWING FIGURES

DETAILED DESCRIPTION

Figure 1:
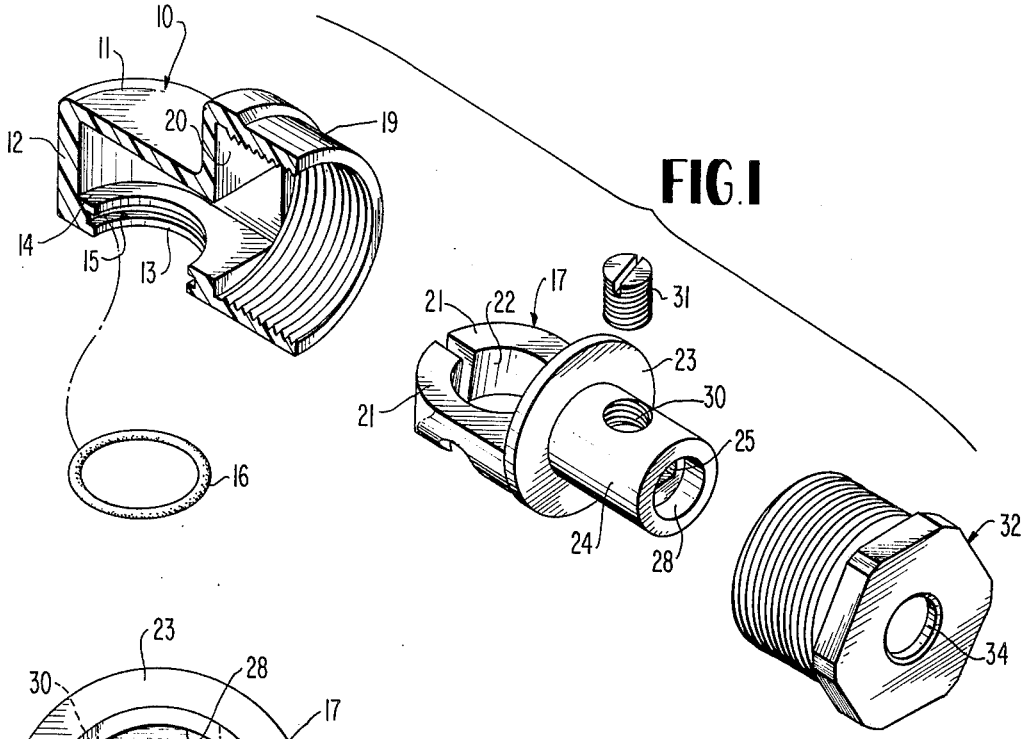
FIG. 1 is an exploded perspective view, partly in section, showing a battery terminal connector and housing means according to the invention.
Figure 3:
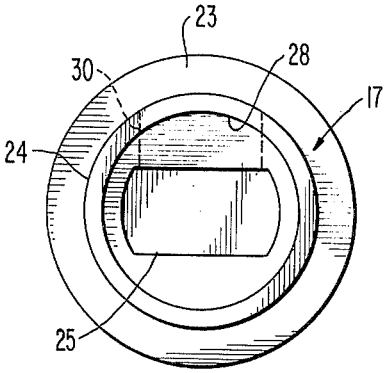
FIG. 3 is an end elevational view of the improved connector cap according to the invention.
Figure 2:
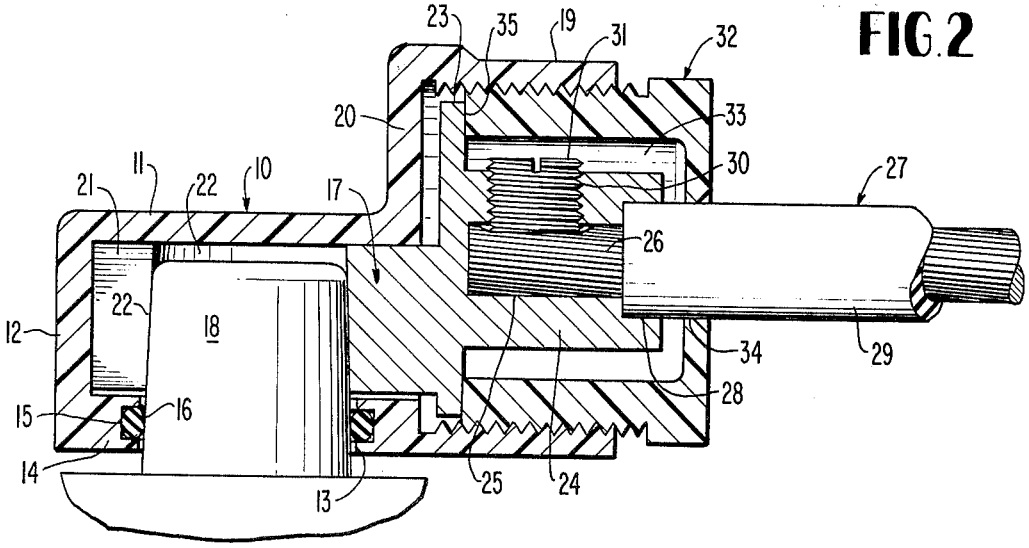
FIG. 2 is an enlarged central vertical section taken through the device as applied to a terminal post of a storage battery.

Referring to the drawings in detail, wherein like numerals designate like parts, the numeral 10 designates a housing preferably formed of clear plastic, such as the type disclosed in U.S. Pat. No. 3,867,007 for the manufacture of the corresponding element in said patent. The structural and functional features of the plastic housing 10 in this invention are identical to those described in said prior patent and therefore only a brief description of the housing 10 is required. It includes a frontal portion having a top wall 11 and a curved forward wall 12 which is preferably concentric with an opening 13 in the bottom wall 14 of the housing. The opening 13 has an annular recess 15 therein adapted to receive an O-ring seal 16 for the purpose specified in the prior patent. As shown in FIG. 2, the frontal portion of the housing 10 encloses and seals the head of the improved split connector cap 17 and the battery terminal post 18 on which the assembly constituting the invention is mounted.

The housing 10 has a rear internally threaded integral sleeve portion 19 with a vertical wall 20 intervened between this sleeve portion and the frontal part of the housing.

The connector cap 17 formed of antimonial lead or the like has split or divided curved jaws 21 defining a vertical through bore 22 which receives the battery terminal post 18 grippingly during use, the two jaws 21 being closed around the terminal post by a camming action with the curved wall 12 of the housing 10, as described in the prior art.

Immediately rearwardly of the jaws 21, the connector cap 17 has an integral rigid radially projecting wall or flange 23 whose rear face is flat and extends without interruption completely around the connector cap circumferentially. The rear flat face of the complete circle flange 23 lies in a plane which is parallel to the axis of the terminal post 18.

The connector cap 17 includes a rear extension 24 having a rear end opening 25 to receive an exposed end 26 of an insulated battery cable 27. The extension 24 may be further recessed in its rear end as at 28 to snugly receive the forward end of the insulation sheath 29 on cable 27.

The connector cap extension 24 has a radial screw-threaded opening 30 at right angles to the axis of opening 25, receiving a radial clamping set screw 31 which engages and secures the exposed cable end 26 in the exact manner described in the prior art.

The assembly further comprises a pressure sleeve 32 preferably formed of the same plastic used to make the housing 10. The pressure sleeve 32 is externally threaded for engagement with internal screw-threads within the housing extension 19, and the bore 33 of the pressure sleeve receives and encloses the connector cap extension 24 and associated elements, FIG. 2. A central opening 34 in the rear wall of pressure sleeve 32 snugly receives the cable insulation sheath 29, as shown, to provide further sealing of the assembly from the ambient atmosphere.

As a very important feature of this invention, the forward flat annular face 35 of pressure sleeve 32 bears on the opposing rear full circle flat face of the flange or wall 23. Frictional contact between these parts exists over substantially the entire area of the flange 23, thus distributing pressure exerted by the threaded sleeve 32 evenly. As previously mentioned, this improves the clamping action of the split connector cap upon the terminal post 18, reduces concentrations of stresses in the connector cap, and substantially eliminates all tendency for the pressure sleeve 32 to loosen because of vibration or other factors. No serrations are required between the bearing flange 23 and the pressure sleeve and no lock nuts or lock washers are necessary.

In all other respects the construction and operation of the invention is unchanged from the prior art as exhibited in the prior patents mentioned herein, and the present invention continues to possess all of the advantageous features in those prior patents plus the improvements disclosed herein.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A battery terminal connector and housing assembly comprising a split connector cap having a bore to grippingly engage a storage battery terminal post, said connector cap having an extension adapted for connection detachably with a battery cable so that such a cable can be mechanically and electrically coupled to the connector cap, a full circle flat abutment face on the connector cap projecting radially of said extension, a housing member for the connector cap substantially enclosing it and having an opening adapted to receive a battery terminal post and being in registration with said bore of the split connector cap, and a pressure sleeve having screw-threaded engagement with said housing member and surrounding and substantially enclosing said extension of the connector cap and having a leading annular flat abutment face adapted to frictionally engage said full circle abutment face of the connector cap and to exert pressure thereon with said pressure distributed evenly around the full circumferential engagement areas of the flat abutment face and said full circle abutment face.

2. The structure of claim 1, and said full circle flat abutment face of said connector cap being the rearward face of an integral radial flange formed on the connector cap between said extension and said bore.

3. The structure of claim 2, and said connector cap extension having a rear end opening adapted to receive an exposed portion of a battery cable, and a clamping element on said extension movable into engagement with an exposed portion of a battery cable when the latter is positioned in said rear end opening.

4. The structure of claim 1, and said housing member having a rearward screw-threaded opening receiving said pressure sleeve therein, said pressure sleeve having external screw-threads.

* * * * *